US007327084B2

(12) United States Patent
Yoo et al.

(10) Patent No.: US 7,327,084 B2
(45) Date of Patent: Feb. 5, 2008

(54) PLASMA DISPLAY PANEL

(75) Inventors: Hun-Suk Yoo, Cheonan-si (KR); Won-Ju Yi, Suwon-si (KR); Jeong-Chull Ahn, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 428 days.

(21) Appl. No.: 11/062,857

(22) Filed: Feb. 23, 2005

(65) Prior Publication Data

US 2005/0242722 A1 Nov. 3, 2005

(30) Foreign Application Priority Data

May 1, 2004 (KR) ..... 10-2004-0030841

(51) Int. Cl.
*H01J 17/49* (2006.01)

(52) U.S. Cl. ..... 313/587; 313/582; 313/586

(58) Field of Classification Search ..... 313/582–587; 315/169.4; 345/41, 43, 67, 71
See application file for complete search history.

(56) References Cited

U.S. PATENT DOCUMENTS 5,371,437 A * 12/1994 Amano ..... 315/169.1
5,541,618 A 7/1996 Shinoda
5,661,500 A 8/1997 Shinoda et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

A plasma display panel. The plasma display panel includes a first substrate made of a transparent material, a second substrate opposite to the first substrate, a first partition wall being located between the first substrate and the second substrate, defining discharge cells together with the first and second substrates, and being made of a dielectric material, upper discharge electrodes being located in the first partition wall and surrounding the discharge cells, lower discharge electrodes being located in the first partition wall to surround the discharge cells and separated from the upper discharge electrodes by a predetermined gap, protrusive electrodes being located in the first partition wall between the upper discharge electrodes and the lower discharge electrodes, connected to one of the upper discharge electrodes and the lower discharge electrodes, and separated from the other discharge electrodes by a predetermined gap, and a phosphor layer arranged in the discharge cells.

21 Claims, 9 Drawing Sheets

U.S. PATENT DOCUMENTS

| | | | |
|---|---|---|---|
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 6,873,105 | B2 * | 3/2005 | Akiba ..... 313/586 |
| 6,903,711 | B2 * | 6/2005 | Akiba ..... 345/67 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 1 May 2004 and there duly assigned Ser. No. 2004-30841.

BACKGROUND OF THE INVENTION

1. Field of the Invention

The present invention relates to a novel design for a plasma display panel (PDP) capable of realizing an image using a gas discharge.

2. Description of the Related Art

A plasma display panel (PDP) has a large screen and excellent characteristics such as high picture-quality, ultra-slim size, light-weighed, and wide view-angle. The PDP can be manufactured in a simpler manner than other flat panel display apparatuses, and the size of the apparatus having a PDP can be easily increased. Thus, the apparatus having a PDP has been important as a next-generation flat panel display apparatus.

Such a PDP is categorized into a DC PDP, an AC PDP, and a hybrid PDP depending on an applied discharge voltage and an opposed discharge PDP and a surface discharge PDP depending on a discharge structure. In these days, the AC PDP having an AC, three-electrode, surface-discharge structure has been widely used.

In PDPs, the electrodes are often formed on the substrates, including the front substrate through which the visible image passes. This can be problematic because much of the visible light is filtered out by the presence of the electrodes and dielectric and protective layers formed on the front substrate. Another drawback of PDPs is that in the discharge cells, the plasma is formed in the same location that the phosphor layers are present. This is also problematical in that the plasma can ion sputter the phosphor layer resulting in an image being burned in. Therefore, what is needed is a design for a PDP that overcomes the above problems.

SUMMARY OF THE INVENTION

It is therefore an object of the present invention to provide an improved design for a PDP.

It is also an object of the present invention to provide a design for a PDP that has fewer or no electrodes formed on the substrates.

It is also an object to provide a design for a PDP where the phosphor layers are formed away from where the plasma is formed.

It is also an object of the present invention to provide a design for a PDP where bright visible images can be viewed using low driving voltages.

It is further an object of the present invention to provide a design for a PDP where there is improved image brightness and improved emission efficiency requiring reduced discharge start voltages to perform low voltage driving.

These and other objects can be achieved by a PDP that includes a first substrate made of a transparent material, a second substrate arranged opposite to the first substrate, a first partition wall arranged between the first substrate and the second substrate, the first partition wall defining discharge cells together with the first and second substrates, the first partition wall being made of a dielectric material, upper discharge electrodes arranged within the first partition wall and surrounding the discharge cells, lower discharge electrodes arranged within the first partition wall and surrounding the discharge cells and separated from the upper discharge electrodes by a first gap, protrusive electrodes arranged in the first partition wall between the upper discharge electrodes and the lower discharge electrodes, the protrusive electrodes being connected to one of the upper discharge electrodes and the lower discharge electrodes, the protrusive electrodes being separated from the other of the upper discharge electrodes and the lower discharge electrodes by a second and lesser gap and a phosphor layer arranged in the discharge cells. Other variations include having the protrusive electrodes on both the upper and the lower discharge electrodes. The upper and the lower discharge electrodes being formed in a ladder shape and running in directions that are essentially perpendicular to each other.

In another embodiment, the upper discharge electrodes and the lower discharge electrodes extend in directions that are essentially parallel to each other. In this embodiment, address electrodes are further formed on the second substrate and run in a direction essentially orthogonal to the upper and the lower discharge electrodes. These address electrodes are covered by a dielectric layer.

Between the two substrates are first and second partition walls. The first partition wall is closer to the first substrate than the second partition walls. The first and the second partition walls divide the space between the two substrates into a plurality of discharge cells. The upper and lower discharge electrodes are formed within the first partition walls and the phosphor layers are formed within the second partition walls. By spatially separating the discharge electrodes from the phorphor layers, the plasma discharge occurs apart from the phosphor layers so the phosphor layers will not be harmed by the plasma.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
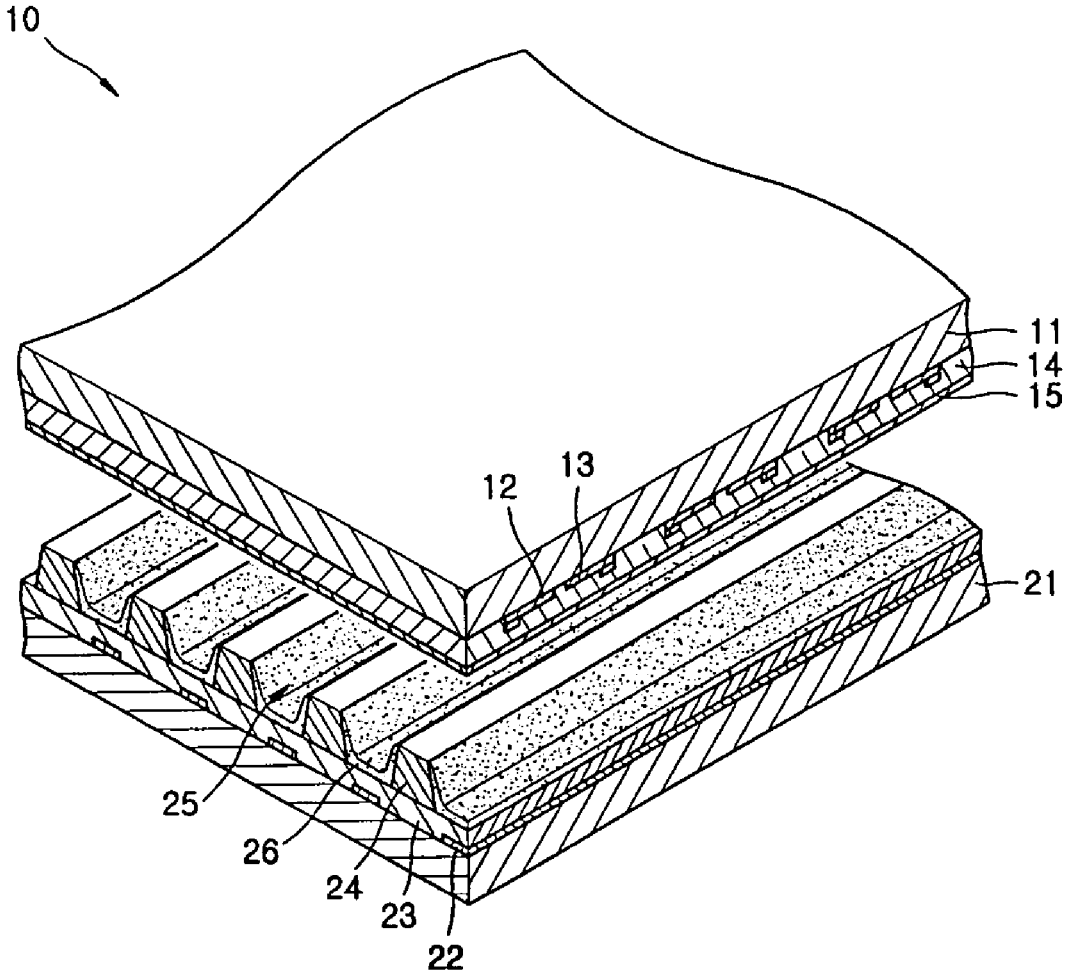
FIG. 1 is a partly exploded perspective view of a plasma display panel (PDP)

Turning now to the figures, FIG. 1 illustrates an AC, three-electrode, surface-discharge PDP 10. The PDP 10 of FIG. 1 includes a first substrate 11 and a second substrate 21 opposite to the first substrate 11. Common electrodes 12 and scan electrodes 13 forming a discharge gap with the common electrodes 12 are formed on a lower surface of the first substrate 11. The common electrodes 12 and the scan electrodes 13 are buried by a first dielectric layer 14. A protective layer 15 is formed on a lower surface of the first dielectric layer 14.

Address electrodes 22 are formed on an upper surface of the second substrate 21 to overlap with the common electrodes 12 and the scan electrodes 13. The address electrodes are buried by a second dielectric layer 23. Partition walls 24 are formed on an upper side of the second dielectric layer 23 to be separated from each other by a predetermined gap so that discharge spaces 25 are partitioned off. A phosphor layer 26 is formed in each of the discharge spaces 25, and a discharge gas is sealed in the discharge spaces 25.

In the PDP 10 having the above structure, in the discharge spaces 25, ultraviolet rays are emitted from plasma generated by discharge. These ultraviolet rays excite the phosphor layer 26, and visible light is emitted from the excited phosphor layer 26 so that a visible image is displayed.

However, because the electrodes 12 and 13, the first dielectric layer 14 and the protective layer 15 are sequentially formed on the lower surface of the first substrate 11, approximately 40% visible light emitted from the phosphor layer 26 is absorbed before it emerges from the first substrate 11, limiting emission efficiency. Furthermore, when displaying the same image for a long time, charged particles of the discharge gas tend to ion-sputter the phosphor layer 26, resulting in the formation of a permanent after-image and reducing the life-span of the PDP.

Figure 2:
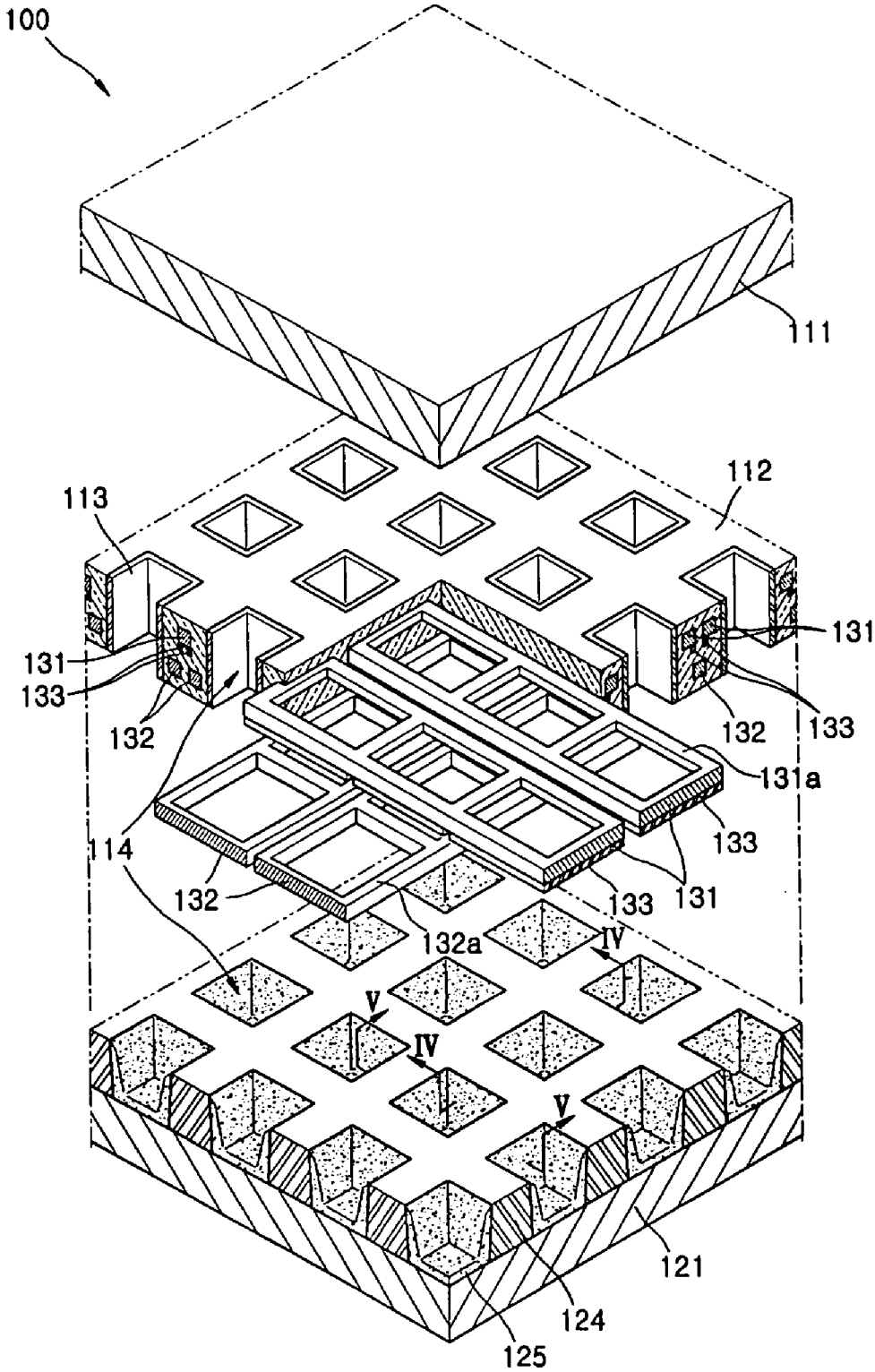
FIG. 2 is a partly exploded perspective view of a PDP according to an embodiment of the present invention.

Turning now to FIGS. 2 through 5, FIGS. 2 through 5 illustrate a plasma display panel (PDP) 100 according to a first embodiment of the present invention. Referring to FIG. 2, a PDP 100 includes a first substrate 111 and a second substrate 121 opposite to the first substrate 111. The first substrate 111 and the second substrate 121 are made of a transparent material such as glass. In particular, since an image is displayed through the first substrate 111 preferably, the first substrate 111 has a high transmissivity.

A first partition wall 112 and a second partition wall 124 are formed between the first substrate 111 and the second substrate 121 in the form of a predetermined pattern. In other words, as illustrated in FIG. 2, the first partition wall 112 and the second partition wall 124 are closed-type partition walls having a matrix shape of rectangular cross-sections. A lower side of the first partition wall 112 corresponds to an upper side of the second partition wall 124 so that a space defined by the first partition wall 112 corresponds to a space defined by the second partition wall 124.

The first partition wall 112 and the second partition wall 124 may be partition walls having a variety of patterns, for example, closed-type partition walls such as waffle or delta, or closed-type partition walls having cross-sections of circular shapes or elliptical shapes or polygonal shapes such as triangular or pentagonal shapes as well as rectangular shapes. In addition, the first partition wall 112 may be a closed-type partition wall, and the second partition wall 124 may be an open-type partition wall such as stripes.

The first partition wall 112 and the second partition wall 124 partition off each display cell corresponding to one subpixel among a red subpixel, a green subpixel, and a blue subpixel that constitutes a unit pixel. Such a design can realize a color image while preventing discharge errors caused by optical cross-talk between the display cells 114. As illustrated in FIG. 2, the first partition wall 112 and the second partition wall 124 may be separate elements or formed of the same material as a single body.

A phosphor layer 125 located in the discharge cell 114 is excited by ultraviolet rays generated during a sustain-discharge and emits visible light. As illustrated in FIG. 2, the phosphor layer 125 is formed in a space defined by the second partition wall 124, that is, on an upper surface of the second substrate 121 and a side surface of the second partition wall 124. The phosphor layer 125 includes phosphor that is excited by ultraviolet rays generated during a discharge and emits red, green, and blue visible light, respectively. For example, a red phosphor layer formed in a discharge cell corresponding to a red subpixel includes phosphor such as Y(V,P)O4:Eu, a green phosphor layer formed in a discharge cell corresponding to a green subpixel includes phosphor such as $Zn_2SiO_4$:Mn and $YBO_3$:Tb, and a blue phosphor layer formed in a discharge cell corresponding to a blue subpixel includes phosphor such as BAM:Eu.

The phosphor layer 125 is formed in the space defined by the second partition wall 124, and thus is separated from a main area of the first partition wall 112 where a discharge occurs by a large gap. Thus, the phosphor layer 125 can be prevented from being ion-sputtered by charged particles so that the life-span of the PDP 100 is extended and the formation of a permanent after-image can be remarkably prevented even though the same image is realized for a long period of time.

A discharge gas is sealed in the discharge cell 114 where the phosphor layer 125 is located. Xe, Ne, or the like, and a mixed gas thereof may be used as the discharge gas.

Upper discharge electrodes 131 and lower discharge electrodes 132 are located in the first partition wall 112 that partitions off the discharge cells 114 together with the second partition wall 124, in a vertical direction. The upper discharge electrodes 131 and the lower discharge electrodes 132 overlap with each other and cause a discharge in the discharge cells 114. Here, the upper discharge electrodes 131 are located on an upper side close to the first substrate 111, and the lower discharge electrodes 132 are located on a lower side (close to the second substrate 121) of first partition wall 112 than the upper discharge electrodes 131. The upper discharge electrodes 131 and the lower discharge electrodes 132, respectively, may be made of a conductive metal such as aluminum, copper, or silver. Since the metallic electrodes have a lower resistance than electrodes made of indium tin oxide (ITO), a discharge response speed can be faster than that of a PDP using ITO electrodes.

The first partition wall 112 where the upper discharge electrodes 131 and the lower discharge electrodes 132 are buried within is made of a dielectric material. By using a dielectric material for the first partition wall 112, electricity can be prevented from flowing directly between the upper discharge electrodes 131 and the lower discharge electrodes 132. Also, by having the first partition wall 112 made of a dielectric material, the upper discharge electrodes 131 and the lower discharge electrodes 132 can be prevented from being damaged by direct collision with the charged particles of the plasma, and charged particles can be induced so that wall charges can be easily accumulated. The dielectric material used in forming the first partition wall 112 may be PbO, $B_2O_3$, or $SiO_2$.

An MgO layer 113 having a predetermined thickness is further formed on a side surface of the first partition wall 112. By using an MgO protective layer 113, the charged particles generated during a discharge can be prevented from being directly collided with the first partition wall 112 so that the first partition wall 112 can be prevented from being damaged by ion sputtering by the charged particles. In addition, as the charged particles directly collide with the MgO layer 113, secondary electrons that contribute to a discharge can be emitted from the MgO layer 113 so that low driving voltage can be realized and an emission efficiency can be increased.

The upper discharge electrodes 131 and the lower discharge electrodes 132, that are located in the first partition wall 112 in the above manner, will now be described in greater detail. The upper discharge electrodes 131 located on an upper side inside the first partition wall 112 are separated from each other by a predetermined gap. The upper discharge electrodes 131 extend in one direction. As illustrated in FIG. 2, one upper discharge electrode 131 has a ladder shape that surrounds four sides of each discharge cell 114 arranged along the direction where the upper discharge electrodes 131 extend. In other words, the upper discharge electrodes 131 have a shape where rectangular discharge portions 131*a* surround four sides of each discharge cell 114, contributing to a discharge while being connected together.

The upper discharge electrodes 131 having the above structure are separated from each other by a predetermined distance taken along a direction perpendicular to the direction that the upper discharge electrodes 131 extend. In addition, the separated portions of the upper discharge electrodes 131 are located together in the first partition wall 112. However, the first partition wall 112 located along the direction where the upper discharge electrodes 131 extend may be a partition wall formed of double partition walls that are separated from each other, and the separated portions of the upper discharge electrodes 131 may be located in each of the double partition walls.

The lower discharge electrodes 132 located below the upper discharge electrodes 131 are separated from each other by another distance and respectively extend in a direction perpendicular to the upper discharge electrodes 131. As illustrated in FIG. 2, one lower discharge electrode 132 has a ladder structure with rectangular discharge portions 132*a* that surround four sides of each discharge cell 114 and contributes to a discharge. These rectangular discharge portions 132*a* of the lower discharge electrodes 132 are connected to each other so as to surround four sides of each discharge cell 114 arranged along the direction that the lower discharge electrodes 132 extend. The lower discharge electrodes 132 having the above structure are separated from each other yet another distance taken along a direction perpendicular to the direction that the lower discharge electrodes 132 extend. The separated portions of the lower discharge electrodes 132 are located together in the first partition wall 112.

Figure 3:
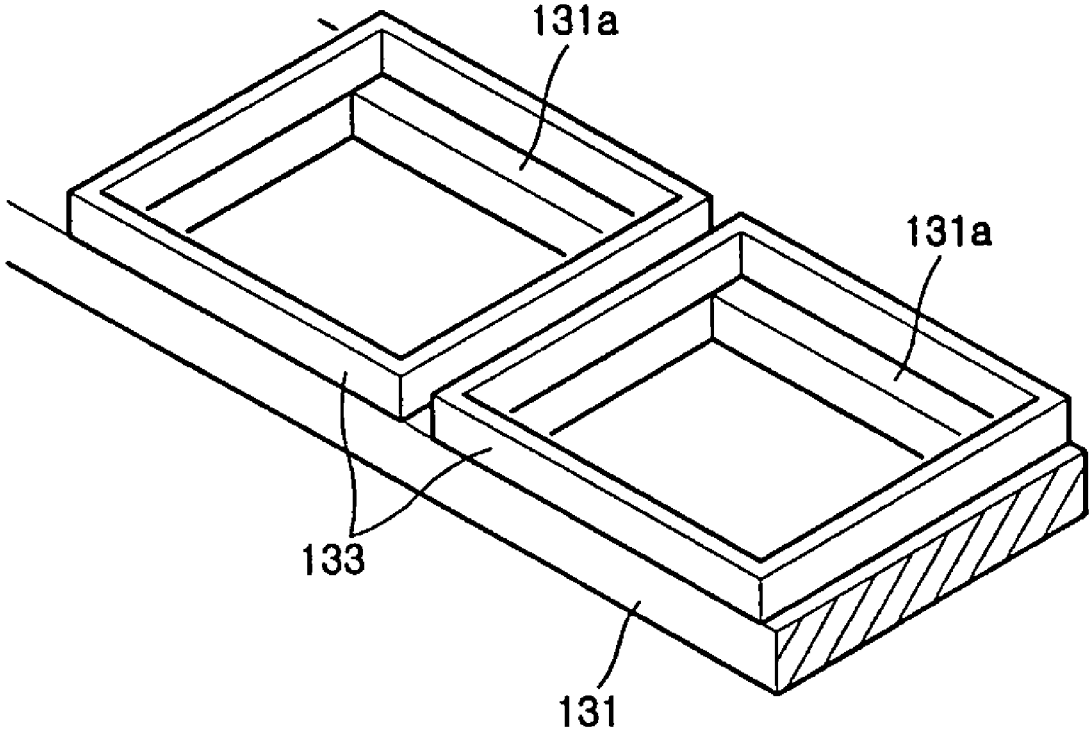
FIG. 3 is a partial perspective view of a lower side of upper discharge electrodes in the PDP of FIG. 2 where protrusive electrodes are connected.

In the upper and lower discharge electrodes 131 and 132 located in the above manner, protrusive electrodes 133 are connected to the upper discharge electrodes 131 and protrude downward towards the lower discharge electrodes reducing the gap between the upper discharge electrodes 131 and the lower discharge electrodes 132. The state in where the protrusive electrodes 133 are connected to lower surfaces of the upper discharge electrodes 131 is illustrated in FIG. 3 in detail. As illustrated in FIG. 3, the protrusive electrodes 133 are divided into a plurality of parts. The divided protrusive electrodes 133 are formed to a predetermined width along lower surfaces of the discharge portions 131*a* of the upper discharge electrodes 131. These protrusive electrodes 133 are present in the portions 131*a* of the upper discharge electrodes 131 that surround the discharge cells. As illustrated in FIG. 3, the width of the protrusive electrodes 133 that surround the discharge cells 114 is smaller than the width of the upper discharge electrode 131, but the present invention is not limited to this. The protrusive electrodes 133 may not be divided into a plurality of parts but have a ladder shape like in the upper discharge electrodes 131 and connect to the upper discharge electrodes 131. Thus, the protrusive electrodes 133 and the upper discharge electrodes 131 may be connected to each other in various ways.

The protrusive electrodes 133, like the upper discharge electrodes 131, may be made of a metal such as aluminum, copper, or silver, or the like. The protrusive electrodes 133 may be formed as separate elements that are later connected to the upper discharge electrodes 131 or instead formed as a single body with the upper discharge electrodes 131.

Figure 4:
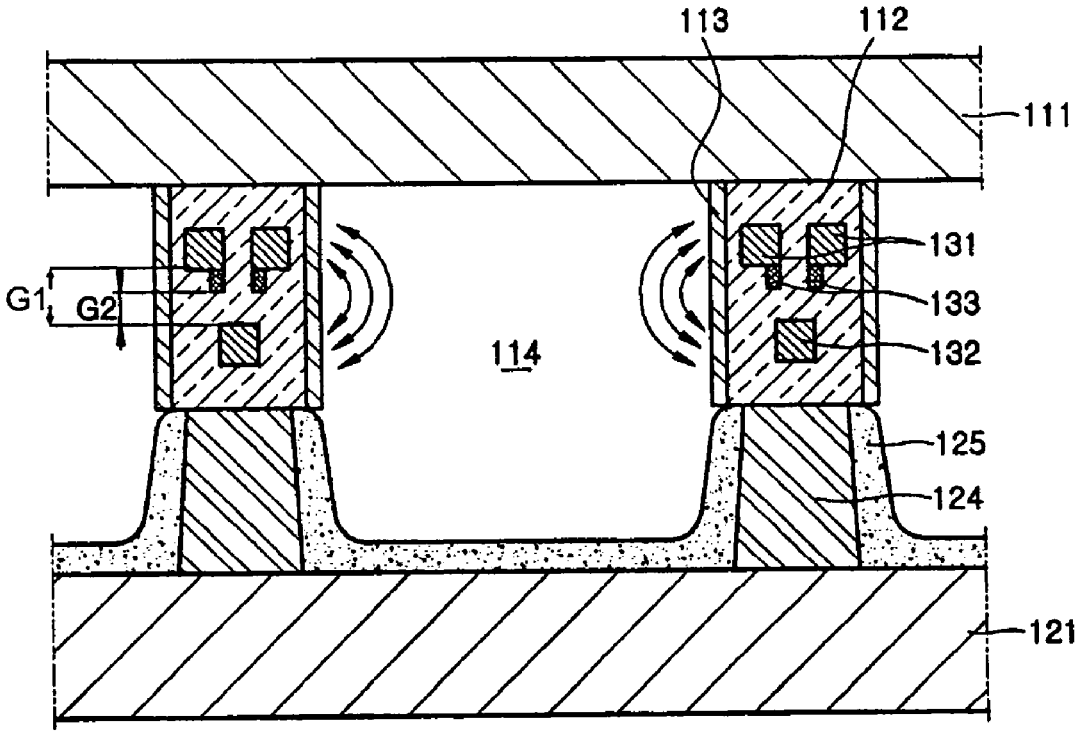
FIG. 4 is a cross-sectional view taken along line IV-IV of FIG. 2.
Figure 5:
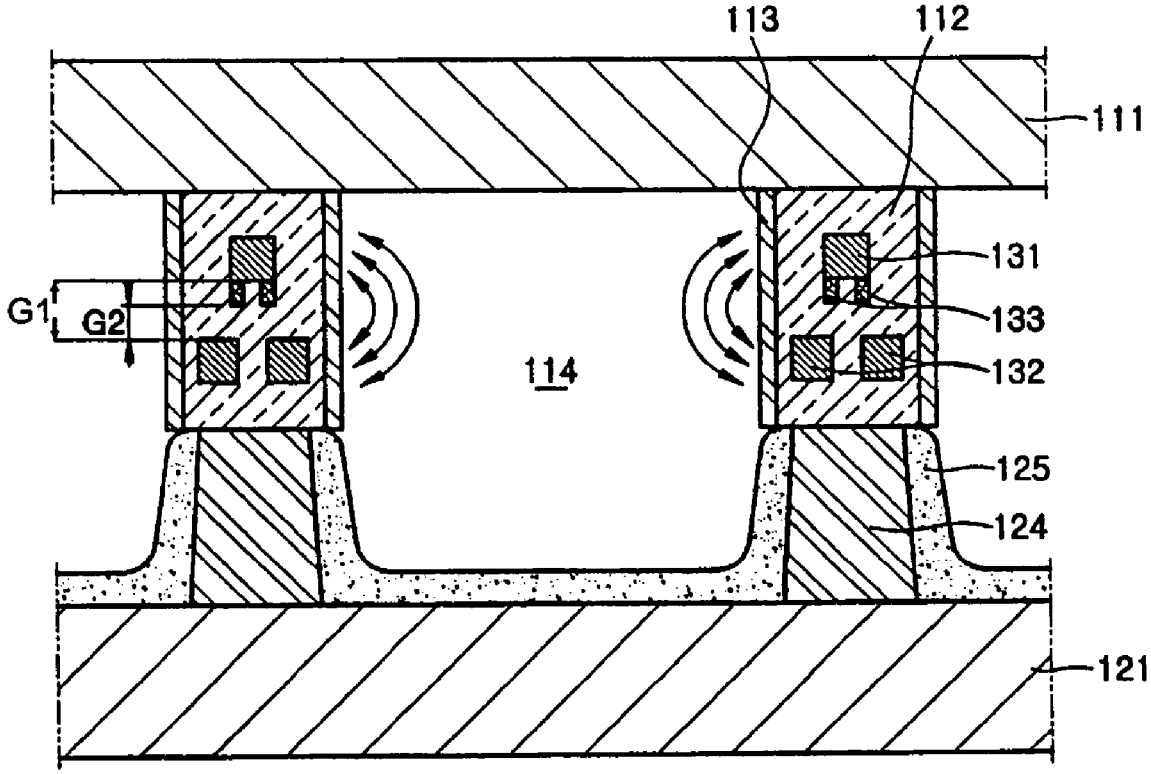
FIG. 5 is a cross-sectional view taken along line V-V of FIG. 2.

The protrusive electrodes 133 are connected to the upper discharge electrodes 131 in the above manner and protrude toward the lower discharge electrodes 132. As illustrated in FIGS. 4 and 5, the distance between the upper discharge electrode 131 and the lower discharge electrode 132 is G1 (or the long gap), and the distance between the protrusive electrode 133 and the lower discharge electrode 132 is G2 (or the short gap). As can be seen from the figures, G2 is less than G1. In no way is the present invention limited by the exact configuration in FIGS. 4 and 5. For example, it is possible to have the protrusive electrodes 133 attached to the lower discharge electrodes 132 instead of the upper discharge electrodes 131, and have the protrusive electrodes 133 protrude upwards from the lower discharge electrodes 132 towards the upper discharge electrodes 131. Also, it is possible instead to have protrusive electrodes 133 attached to both the upper discharge electrodes 131 and the lower discharge electrodes 132 and protruding towards each other to reduce the size of the gap between the two electrodes.

Thus, any one of the upper discharge electrode 131 and the lower discharge electrode 132 serves as an address and sustain electrode, and the other one serves as a scan and sustain electrode. For example, when the upper discharge electrode 131 serves as the address and sustain electrode and the lower discharge electrode 132 serves as the scan and sustain electrode, if an address voltage is applied to the upper discharge electrode 131 and a scan voltage is applied to the lower discharge electrode 132, an address discharge occurs in the discharge cell 114 corresponding to a cross point between the upper discharge electrode 131 and the lower discharge electrode 132. After the address discharge occurs, if a sustain voltage is alternately applied between the upper discharge electrode 131 and the lower discharge electrode 132, the charged particles move in a vertical direction and a sustain discharge occurs.

In this discharge, since the distance between the protrusive electrode 133 connected to the upper discharge electrode 131 and the lower discharge electrode 132 is G2, a stronger electric field is produced than when the distance between the electrodes is G1. Thus, a stable discharge can be realized where a discharge starts from the short gap G2 to the long gap G1 and occurs diffusely in all of the discharge cells 114 along a discharge electrode. Also, by shortening the distance between the electrodes to G2, and a discharge can be initiated with less voltage.

As illustrated in FIGS. 4 and 5, the sustain discharge that occurs between the upper discharge electrodes 131 and the lower discharge electrodes 132 having the above structure is concentrated in an upper side of the discharge cell 114 closest to first substrate 111. Also, the sustain discharge is formed on all sides of the discharge cell 114 in a vertical direction. In addition, the sustain discharge that occurs on all sides of the discharge cell 114 gradually occurs on a central side of the discharge cell 114. Thus, the discharge area becomes larger than that of the PDP 10 of FIG. 1. The size of the area where a sustain discharge occurs is increased, and space charges in a discharge cell that have not been efficiently used in a PDP 10 of FIG. 1 contribute to emission in the PDP 100 of the present invention. By such a design, the amount of plasma generated during a discharge can be increased so that low driving voltage can be realized. Meanwhile, ultraviolet rays are emitted from the discharge gas during the sustain discharge. The phosphor layer 125 located within the discharge cell 114 is excited by the ultraviolet rays so that visible light is emitted from the excited phosphor layer 125 and an image is realized.

Figure 6:
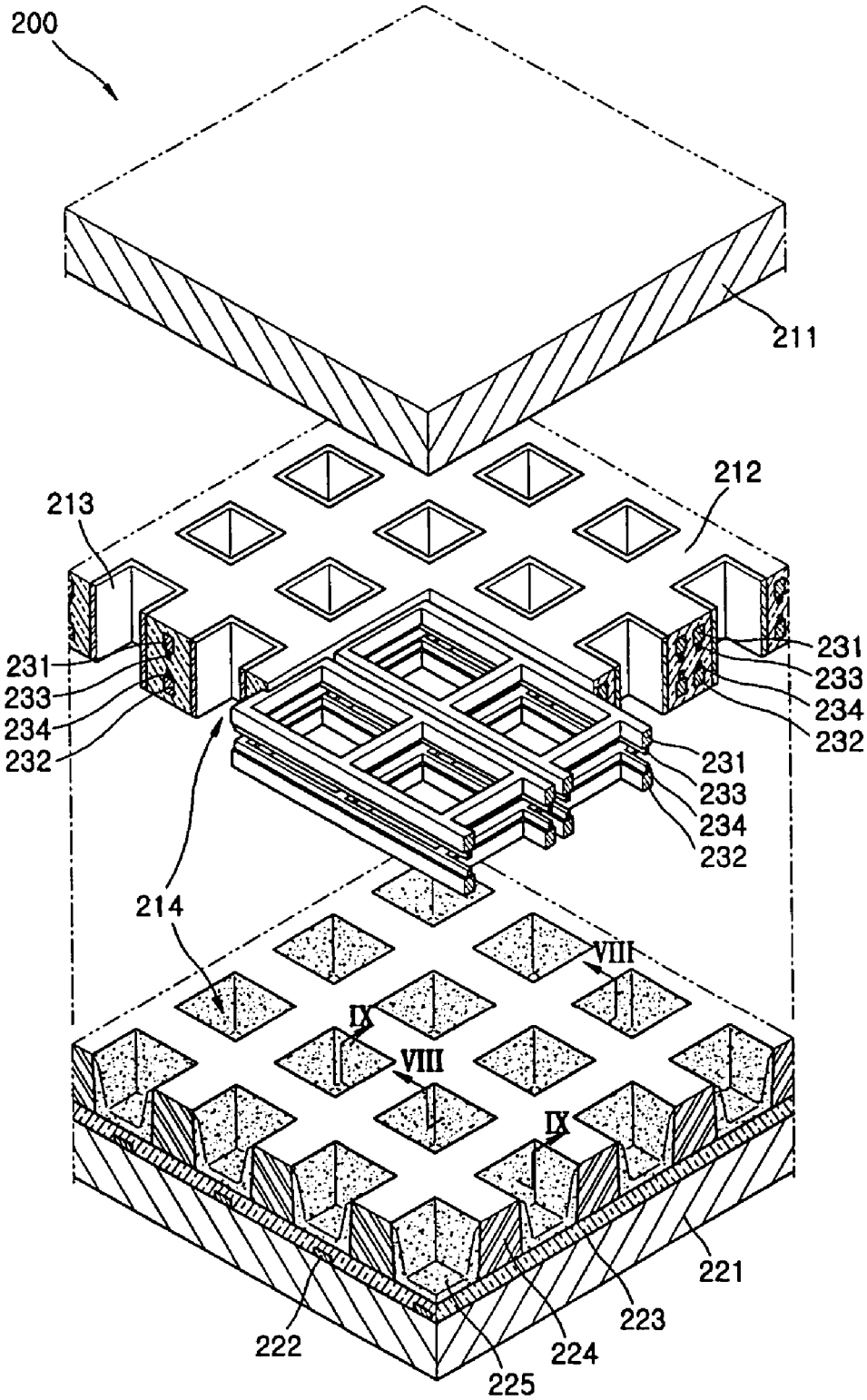
FIG. 6 is a partly exploded perspective view of a PDP according to another embodiment of the present invention.

Turning now to FIGS. 6 through 9, FIGS. 6 through 9 illustrate a plasma display panel (PDP) 200 according to a second embodiment of the present invention. Referring to FIG. 6, a PDP 200 includes a first substrate 211 and a second substrate 221 opposite to the first substrate 111.

A first partition wall 212 and a second partition wall 224 are located between the first substrate 211 and the second substrate 221. The first partition wall 212 and the second partition wall 224 are closed-type partition walls having a matrix shape of rectangular cross-sections. A lower side of the first partition wall 212 corresponds to an upper side of the second partition wall 224 so that a space defined by the first partition wall 212 corresponds to a space defined by the second partition wall 224. Although rectangular cross sections are illustrated, the first partition wall 212 and the second partition wall 224 may be partition walls having a variety of other patterns, like in the first embodiment.

The first partition wall 212 and the second partition wall 224 partition off each display cell 214 corresponding to one subpixel among a red subpixel, a green subpixel, and a blue subpixel, that constitutes a unit pixel. Such a design can realize a color image. Address electrodes 222 are formed on an upper surface of the second substrate 221 opposite to the first substrate 211, and the address electrodes 222 are covered with dielectric layers 223. Each of the address electrodes 222 corresponds to each of the discharge cells 214 so that the discharge cells 214 where a discharge begins can be selected. The address electrodes 222 are formed in the form of stripes, but the present invention is not limited to this.

A phosphor layer 225 is excited by ultraviolet rays generated during a sustain-discharge and generate visible light from the discharge cell 214. As illustrated in FIG. 6, the phosphor layer 225 is formed in a space defined by the second partition wall 224, that is, on an upper surface of the dielectric layer 223 and on a side surface of the second partition wall 224. Here, the phosphor layer 225 includes phosphor that is excited by ultraviolet rays generated during a discharge. The phosphor layer 225 emits red, green, and blue visible light, respectively as a result of the excitation. A discharge gas such as Xe, Ne, or the like, and a mixed gas thereof is sealed in the discharge cells 214 where the phosphor layer 225 is located.

Upper discharge electrodes 231 and lower discharge electrodes 232 are located in the first partition wall 212 that partitions off the discharge cells 214 together with the second partition wall 224, in a vertical direction. The upper discharge electrodes 231 and the lower discharge electrodes 232 overlap with each other and cause a discharge in the discharge cells 214. In addition, the first partition wall 212 that surrounds both the upper discharge electrodes 231 and the lower discharge electrodes 232 is made of a dielectric material and is covered by an MgO layer 213.

The upper discharge electrodes 231 and the lower discharge electrodes 232 that are located in the first partition wall 212 will now be described in greater detail. The upper discharge electrodes 231 located in an upper portion of the first partition wall 212 are separated from each other by a predetermined distance and respectively extend along the discharge cells 214 arranged in a direction perpendicular to a lengthwise direction of the address electrodes 222. Here, one upper discharge electrode 231 has a ladder shape that surrounds four sides of each discharge cell 214. In other words, the upper discharge electrodes 231 have a shape where rectangular discharge portions 231*a* surround all four sides of each discharge cell 214, contributing to a discharge and are connected to each other.

The upper discharge electrodes 231 having the above structure are separated from each other by another distance taken along the lengthwise direction of the address electrodes 222. In addition, the separated portions of the upper discharge electrodes 231 are located together in the first partition wall 212.

The lower discharge electrodes 232 located below the upper discharge electrodes 231 are separated from each other by yet another distance and respectively extend in a direction parallel to the upper discharge electrodes 231. Here, one lower discharge electrode 232 has a ladder structure having rectangular discharge portions 232*a* surrounding four sides of each discharge cell 214 and contributing to a discharge and are connected to each other, so as to surround four sides of each discharge cell 214 arranged along the direction perpendicular to the lengthwise direction of the address electrodes 222. The lower discharge electrodes 232 having the above structure are separated from each other by yet another distance taken along the lengthwise direction of the address electrodes 222. The separated portions of the lower discharge electrodes 232 are located together in the first partition wall 212.

Figure 7:
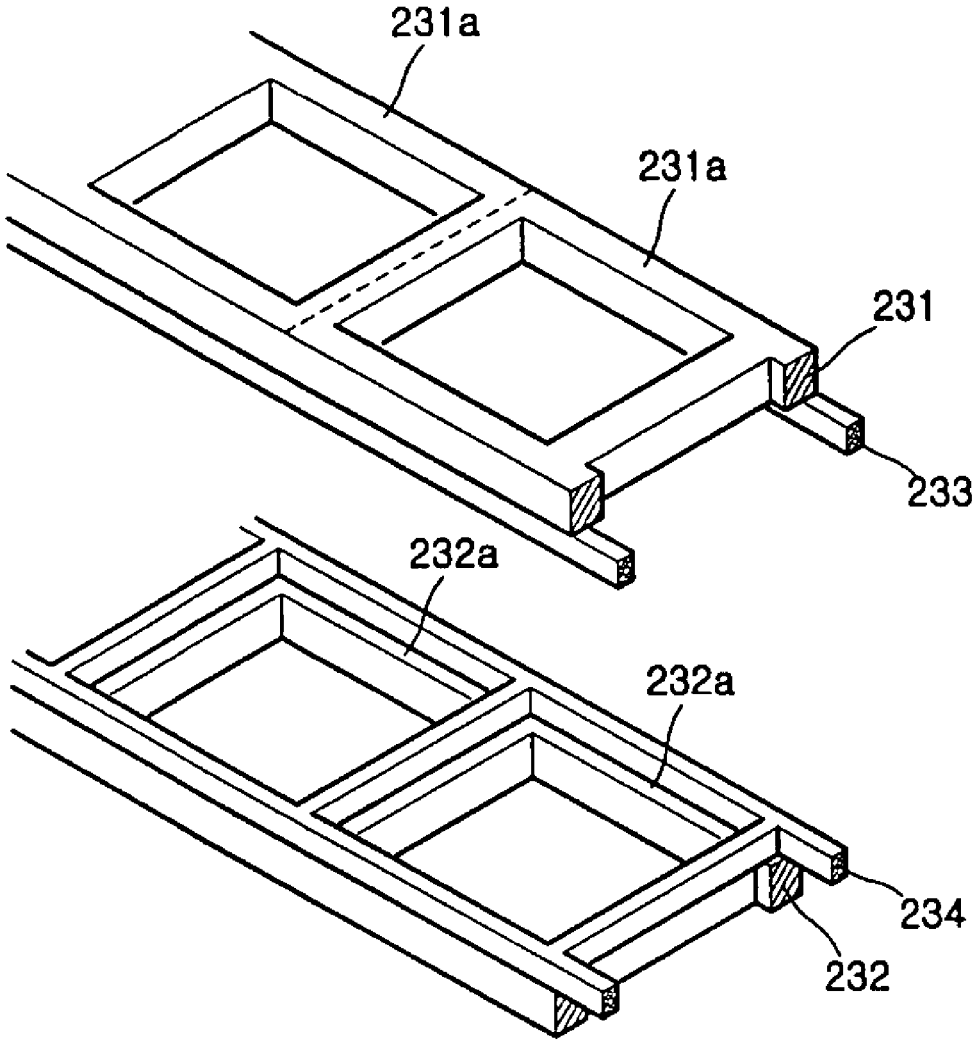
FIG. 7 is a partial perspective view of upper and lower discharge electrodes in the PDP of FIG. 6.

Meanwhile, upper protrusive electrodes 233 are connected to the upper discharge electrodes 231 and protrude in a downward direction towards the lower discharge electrodes 232. As illustrated in FIG. 7, the upper protrusive electrodes 233 have a ladder shape, and are connected to the upper discharge electrodes 231 to surround the discharge portions 231*a* so that the upper protrusive electrodes 233 surround the discharge cells 214. The width of the upper protrusive electrode 233 that surround the discharge cells 214 is smaller than the width of the upper discharge electrode 231 that surround the discharge cells 214. However, the upper protrusive electrodes 233 and the upper discharge electrodes 231 may be connected to each other in various ways.

Lower protrusive electrodes 234 are connected to the lower discharge electrodes 232 and protrude from the lower discharge electrodes 232 in an upward direction towards upper discharge electrodes 231. The lower protrusive electrodes 234 have a ladder shape, like in the upper protrusive electrodes 233, and are connected to the lower discharge electrodes 232 to surround the discharge portions 232*a* so that the lower protrusive electrodes 234 surround the discharge cells 214.

The upper and lower protrusive electrodes 233 and 234, like for the upper and lower discharge electrodes 231 and 232, may be made of a metal such as aluminum, copper, or silver. The upper and lower protrusive electrodes 233 and 234 may be separate elements that are connected to the upper and lower discharge electrodes 231 and 232 or may instead be formed as a single body with the upper and lower discharge electrodes 231 and 232.

Figure 8:
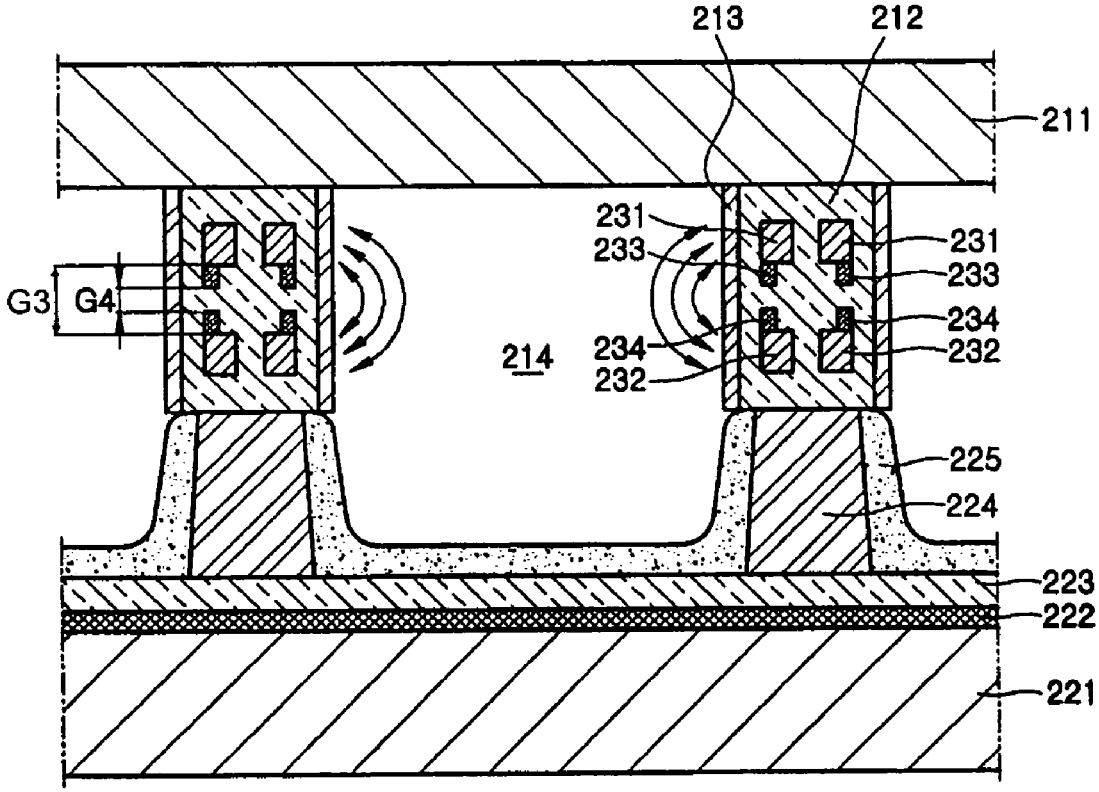
FIG. 8 is a cross-sectional view taken along line VIII-VIII of FIG. 6.
Figure 9:
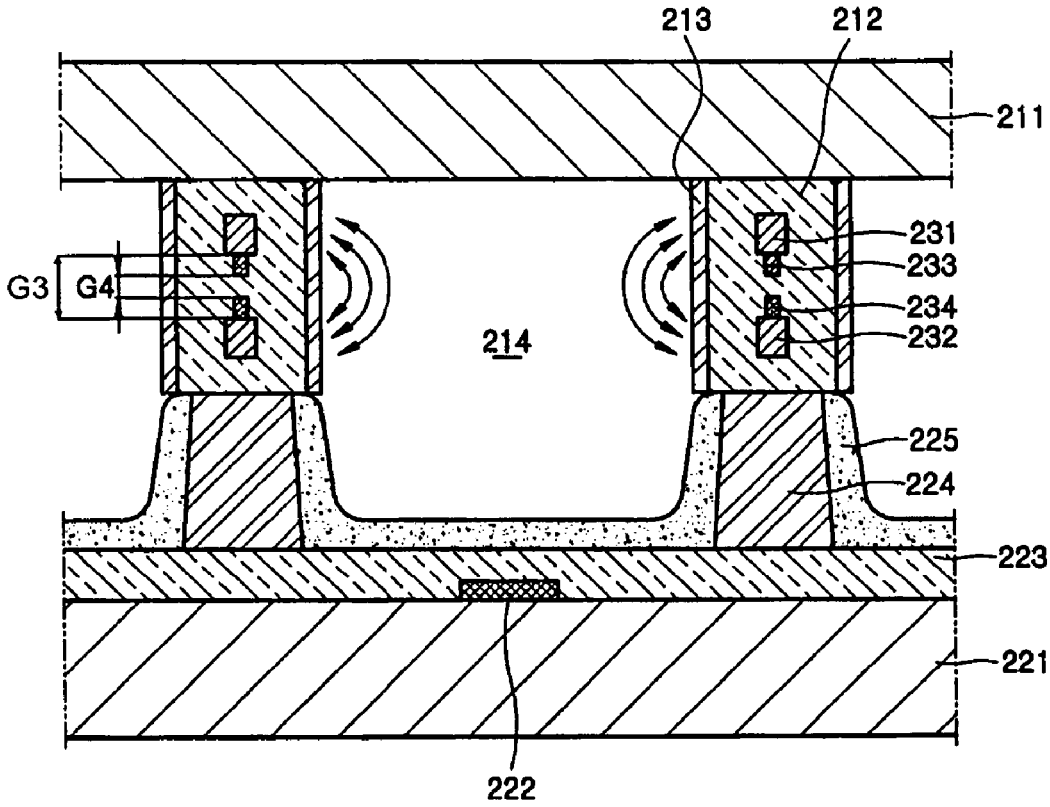
FIG. 9 is a cross-sectional view taken along line IX-IX of FIG. 6.

As described above, the upper protrusive electrodes 233 are connected to lower portions of the upper discharge electrodes 231 and the lower protrusive electrodes 234 are connected to upper portions of the lower discharge electrodes 232 so that the upper and lower protrusive electrodes 233 and 234 are opposite to each other. As such, as illustrated in FIGS. 8 and 9, a distance between the upper discharge electrode 231 and the lower discharge electrode 232 is G3, and a distance between the upper protrusive electrode 233 and the lower protrusive electrode 234 is G4, where G4 is shorter than G3. One of the upper discharge electrode 231 and the lower discharge electrode 232 located in the above manner corresponds to a common electrode, and the other thereof corresponds to a scan electrode. A sustain voltage is alternately applied between the upper discharge electrode 231 and the lower discharge electrode 232 so that the charged particles move in a vertical direction and a sustain discharge occurs.

In the sustain discharge, since the space between the upper protrusive electrode 233 and the lower protrusive electrode 234 is just G4, a stronger electric field is formed than when the distance is G3. Thus, a stable discharge can be realized in a discharge mechanism where a discharge starts from between lower protrusive electrode 234 and upper protrusive electrode 233 and occurs diffusely in all of the discharge cells 214 along a discharge electrode. Since the distance between the electrodes is reduced, a discharge start voltage can be reduced. Because distance G3 separates the upper discharge electrode 231 and the lower discharge electrode 232, a long and uniform discharge path can be formed so that wall charges can be uniformly distributed.

Meanwhile, it is more preferable that the upper discharge electrode 231 serves as the common electrode and the lower discharge electrode 232 serves as the scan electrode. This is because an address voltage applied between the lower discharge electrode 232 and the address electrode 222 is reduced and low-voltage addressing between the lower discharge electrode 232 and the address electrode 222 can be realized. After the address discharge occurs, charges are accumulated near the upper discharge electrodes 231 and the lower discharge electrodes 232, respectively, such that the address electrodes 222 allow the sustain discharge between the upper discharge electrodes 231 and the lower discharge electrodes 232 to more easily occur, resulting in a reduction in a discharge start voltage.

The operation of the PDP 200 having the above structure will now be briefly described. First, an address voltage is applied between the lower discharge electrodes 232 serving as a scan electrode and the address electrodes 222 so that an address discharge occurs. As the result of the address discharge, the discharge cells 214 where a sustain discharge occurs are selected. After the address discharge occurs, if a sustain voltage is alternately applied between the upper discharge electrodes 231 and the lower discharge electrodes 232 located in the selected discharge cells 214, a sustain discharge occurs between the upper and lower discharge electrodes 231 and 232 where the upper and lower protrusive electrodes 233 and 234, respectively are connected, and ultraviolet rays are emitted from a discharge gas excited by the sustain discharge. The phosphor layer 225 located in the discharge cells 214 is excited by the ultraviolet rays so that visible light is emitted from the excited phosphor layer 225 and a visible image is realized.

As described above, the PDP according to the present invention has the following advantages. First, a long gap and a short gap are formed between the upper discharge electrodes and the lower discharge electrodes such that a stable discharge can be realized and a discharge start voltage can be reduced. In addition, a discharge path can be formed long and uniform such that wall charges can be uniformly distributed. Second, since electrodes and dielectric layers do not exist in an area of the first substrate where visible light emitted from the discharge cell must pass through, an aperture ratio becomes higher such that transmission through the first substrate is improved. In addition, since a discharge occurs on all sides of the discharge cell, a discharge area is remarkably enlarged such that low driving voltage can be realized. Third, since the phosphor layer located in a lower portion of the discharge cell is separated by a significant distance from a main area where a sustain discharge occurs, the phosphor layer is less susceptible to being ion sputtered when a plasma is generated. This improves the length of the life of the PDP while preventing image burn in.

While the present invention has been particularly illustrated and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a first substrate comprising a transparent material;

a second substrate arranged opposite to the first substrate;

a first partition wall arranged between the first substrate and the second substrate, the first partition wall defining discharge cells together with the first and second substrates, the first partition wall comprising a dielectric material;

upper discharge electrodes arranged within the first partition wall and surrounding the discharge cells;

lower discharge electrodes arranged within the first partition wall and surrounding the discharge cells and separated from the upper discharge electrodes by a first distance;

protrusive electrodes arranged in the first partition wall between the upper discharge electrodes and the lower discharge electrodes, the protrusive electrodes being connected to one of the upper discharge electrodes and the lower discharge electrodes, the protrusive electrodes being separated from the other of the upper discharge electrodes and the lower discharge electrodes by a second distance that is less than the first distance; and a phosphor layer arranged in the discharge cells.

2. The plasma display panel of claim 1, a distance between one of said upper and a corresponding lower discharge electrode being the first distance, and a distance between the one of said protrusive electrodes and a corresponding other upper discharge electrode and the lower discharge electrode being the second distance that is less than the first distance.

3. The plasma display panel of claim 1, the protrusive electrodes surround the discharge cells.

4. The plasma display panel of claim 1, the protrusive electrodes comprise a material selected from the group consisting of aluminum, copper and silver.

5. The plasma display panel of claim 1, comprised of a protrusive electrode is formed on both the upper discharge electrode and the lower discharge electrode, both protrusive electrodes being separated from each other by a third distance.

6. The plasma display panel of claim 5, comprised of a distance between the upper discharge electrode and the lower discharge electrode forms a first distance that is longer than the third distance.

7. The plasma display panel of claim 5, comprised of the protrusive electrodes surrounding the discharge cells.

8. The plasma display panel of claim 1, comprised of the upper discharge electrodes and the lower discharge electrodes each comprising a material selected from the group consisting of aluminum, copper and silver.

9. The plasma display panel of claim 8, with the protrusive electrodes comprising a material selected from the group consisting of aluminum, copper and silver.

10. The plasma display panel of claim 1, comprised of the lower discharge electrodes extending along a direction perpendicular to a direction that the upper discharge electrodes extend.

11. The plasma display panel of claim 1, comprised of each upper discharge electrode extending in a direction that is parallel to a direction that each lower discharge electrode extends, the plasma display panel further comprising address electrodes that extend in a direction perpendicular to the upper and lower discharge electrodes.

12. The plasma display panel of claim 11, the address electrodes are arranged in a dielectric layer arranged between the second substrate and the phosphor layer.

13. The plasma display panel of claim 11, comprised of a plurality of upper discharge electrodes being adapted to serve as common electrodes, and a plurality of lower discharge electrodes being adapted to serve as scan electrodes.

14. The plasma display panel of claim 1, further comprising a second partition wall arranged between the first partition wall and the second substrate and defining the discharge cells together with the first partition wall, the phosphor layer being arranged in a space defined by the second partition wall.

15. The plasma display panel of claim 1, further comprising an MgO layer that covers a side surface of the first partition wall.

16. A plasma display panel, comprising:

a first substrate comprising a transparent material;

a second substrate arranged opposite to the first substrate;

a partition wall arranged between the first substrate and the second substrate, the first partition wall dividing a space between the first and the second substrates into a plurality of discharge cells, the partition wall comprising a dielectric material;

upper discharge electrodes arranged within the partition wall and surrounding the discharge cells;

lower discharge electrodes arranged within the partition wall and surrounding the discharge cells and separated from the upper discharge electrodes by a first distance, the lower discharge electrodes running in a direction that is orthogonal to the upper discharge electrodes;

protrusive electrodes arranged in the partition wall between the upper discharge electrodes and the lower discharge electrodes, the protrusive electrodes being connected to one of the upper discharge electrodes and the lower discharge electrodes, the protrusive electrodes being separated from the other of the upper discharge electrodes and the lower discharge electrodes by a second distance that is less than the first distance; and a phosphor layer arranged in the discharge cells, said phosphor layer not being present between the upper discharge electrodes and the lower discharge electrodes.

17. The plasma display panel of claim 16, comprised of the first and the second substrates being absent of electrodes arranged thereon, the upper and lower discharge electrodes and the protrusive electrodes each being absent indium tin oxide and each being absent indium zinc oxide.

18. The plasma display panel of claim 16, comprised of a plurality of upper discharge electrodes, a plurality of lower discharge electrodes, and the protrusive electrodes arranged on both of the upper discharge electrodes and the lower discharge electrodes and reducing a distance between the upper and the lower discharge electrodes.

19. A plasma display panel, comprising:

a first substrate comprising a transparent material;

a second substrate arranged opposite to the first substrate;

a partition wall arranged between the first substrate and the second substrate, the first partition wall dividing a space between the first and the second substrates into a plurality of discharge cells, the partition wall comprising a dielectric material;

upper discharge electrodes arranged within the partition wall and surrounding the discharge cells;

lower discharge electrodes arranged within the partition wall and surrounding the discharge cells and separated from the upper discharge electrodes by a first distance, the lower discharge electrodes running in a direction that is parallel to the upper discharge electrodes;

protrusive electrodes arranged in the partition wall between the upper discharge electrodes and the lower discharge electrodes, the protrusive electrodes being connected to one of the upper discharge electrodes and the lower discharge electrodes, the protrusive electrodes being separated from the other of the upper discharge electrodes and the lower discharge electrodes by a second distance that is less than the first distance; and a phosphor layer arranged in the discharge cells, said phosphor layer not being present between the upper discharge electrodes and the lower discharge electrodes.

20. The plasma display panel of claim 19, the first substrate being absent of electrodes formed thereon, the upper and lower discharge electrodes and the protrusive electrodes each being absent indium tin oxide and each being absent indium zinc oxide.

21. The plasma display panel of claim 19, further comprising address electrodes formed on the second substrate and extending in a direction that is orthogonal to both the upper and lower discharge electrodes.

* * * * *